US008893678B2

(12) United States Patent
Schädel et al.

(10) Patent No.: US 8,893,678 B2
(45) Date of Patent: Nov. 25, 2014

(54) VALVE DRIVE ARRANGEMENT

(75) Inventors: Tobias Schädel, Remshalden-Grunbach (DE); Sven Skorupa, Oberboihingen (DE)

(73) Assignee: Daimler AG, Stuttgart (DE)

( * ) Notice: Subject to any disclaimer, the term of this patent is extended or adjusted under 35 U.S.C. 154(b) by 113 days.

(21) Appl. No.: 13/351,563

(22) Filed: Jan. 17, 2012

(65) Prior Publication Data

US 2012/0138000 A1 Jun. 7, 2012

Related U.S. Application Data

(63) Continuation-in-part of application No. PCT/EP2010/003828, filed on Jun. 23, 2010.

(30) Foreign Application Priority Data

Jul. 28, 2009 (DE) ..... 10 2009 034 990

(51) Int. Cl.
*F01L 1/34* (2006.01)
*F01L 1/053* (2006.01)
*F01L 13/00* (2006.01)

(52) U.S. Cl.
CPC ..... *F01L 13/0036* (2013.01); *F01L 2013/0052* (2013.01); *F01L 1/0532* (2013.01)
USPC ..... 123/90.18; 123/90.17; 123/90.16

(58) Field of Classification Search
USPC ..... 123/90.15–90.18, 90.6
See application file for complete search history.

(56) References Cited

U.S. PATENT DOCUMENTS

| | | | | |
|---|---|---|---|---|
| 4,332,222 | A | 6/1982 | Papez | |
| 5,165,303 | A * | 11/1992 | Riemscheid et al. | 74/567 |
| 5,577,420 | A * | 11/1996 | Riemscheid et al. | 74/567 |
| 5,893,345 | A * | 4/1999 | Sugimoto et al. | 123/90.17 |
| 7,210,440 | B2 * | 5/2007 | Lawrence et al. | 123/90.6 |
| 8,028,666 | B2 * | 10/2011 | Clever et al. | 123/90.17 |
| 8,297,247 | B2 * | 10/2012 | Schoeneberg et al. | 123/90.18 |
| 8,307,794 | B2 * | 11/2012 | Lengfeld et al. | 123/90.15 |
| 8,387,579 | B2 * | 3/2013 | Stolk et al. | 123/90.18 |
| 2008/0257104 | A1 * | 10/2008 | Lancefield et al. | 74/568 R |
| 2010/0199935 | A1 * | 8/2010 | Lengfeld et al. | 123/90.15 |
| 2012/0037106 | A1 * | 2/2012 | Werler et al. | 123/90.18 |
| 2012/0285405 | A1 * | 11/2012 | Pierik | 123/90.15 |
| 2013/0104824 | A1 * | 5/2013 | Weinmeister | 123/90.18 |

FOREIGN PATENT DOCUMENTS

| | | | |
|---|---|---|---|
| DE | 39 43 426 | | 4/1991 |
| DE | 3943426 | C1 | 4/1991 |
| DE | 10 2007 016 977 | | 10/2008 |
| DE | 102007016977 | A1 | 10/2008 |
| DE | 102007037747 | A1 | 2/2009 |

(Continued)

*Primary Examiner* — Thomas Denion
*Assistant Examiner* — Steven D Shipe
(74) *Attorney, Agent, or Firm* — Klaus J. Bach

(57) ABSTRACT

In a valve drive arrangement of an internal combustion engine, having a first camshaft unit which comprises an outer shaft and primary cams connected to the outer shaft, a second camshaft unit which comprises an inner shaft disposed in the outer shaft, secondary cams connected to the inner shaft and disposed on the outer shaft and an adjusting unit for adjusting the two camshaft units relative to each other an adjusting unit provides for an at least two stage sequential valve stroke wherein, in a switching process, two shaft elements of a camshaft unit are displaced sequentially one after the other.

11 Claims, 4 Drawing Sheets

(56) References Cited

FOREIGN PATENT DOCUMENTS

| | | | | |
|---|---|---|---|---|
| DE | 102007056337 | A1 | | 5/2009 |
| DE | 10 2007 037 747 | | | 12/2009 |
| EP | 025058 | A2 | * | 1/1988 |
| EP | 0 254 058 | | | 9/1992 |
| GB | 2421557 | B | * | 10/2009 |
| JP | 2006-105062 | | | 4/2006 |
| JP | 2009-144521 | | | 7/2009 |
| JP | 2010-535965 | | | 11/2010 |
| JP | 2010-569567 | | | 11/2010 |
| JP | 2010-538211 | | | 12/2010 |
| JP | 2011-504561 | | | 2/2011 |
| WO | WO 2008107106 | A1 | * | 9/2008 |
| WO | WO 2009/021699 | | | 2/2009 |
| WO | WO 2009021667 | A1 | * | 2/2009 |
| WO | WO2009/030434 | | | 3/2009 |
| WO | WO 2009/065475 | | | 5/2009 |

* cited by examiner

VALVE DRIVE ARRANGEMENT

This is a Continuation-In-Part application of pending international patent application PCT/EP2010/003828 filed Jun. 23, 2010 and claiming the priority of German patent application 10 2009 034 990.1 filed Jul. 28, 2009.

BACKGROUND OF THE INVENTION

The invention relates to a valve drive arrangement including a camshaft having a hollow outer camshaft part with an inner camshaft disposed within the outer camshaft part.

DE 39 43 426 C1 already discloses an internal combustion engine valve drive arrangement with a first camshaft unit which comprises an outer shaft and primary cams connected to the outer shaft, with a second camshaft unit which comprises an inner shaft disposed in the outer shaft and secondary cams disposed on the outer shaft and connected to the inner shaft, and with an adjusting unit for adjusting the positions of the two camshaft units relative to each other.

DE 10 2007 037747 A1 discloses an internal combustion engine valve drive switching device with a switching unit which comprises an executing unit for executing, on the basis of at least one signal, a first switching process and then to execute a second switching process independently of an electronic evaluation. The internal combustion engine valve drive switching device comprises a control gate which is formed by at least two switching units of the executing unit.

It is in particular the object of the present invention to provide a cost-effective valve drive arrangement with adjustable valve timing and valve strokes.

SUMMARY OF THE INVENTION

In a valve drive arrangement of an internal combustion engine, having a first camshaft unit which comprises an outer shaft and primary cams connected to the outer shaft, a second camshaft unit which comprises an inner shaft disposed in the outer shaft, secondary cams connected to the inner shaft and disposed on the outer shaft and an adjusting unit for adjusting the two camshaft units relative to each other, an adjusting unit provides for an at least two stage sequential valve stroke adjustment wherein, in a switching process, two shaft elements of a camshaft unit are displaced sequentially one after the other.

The adjusting unit provides for an at least two stage sequential valve stroke switching. With the two stage sequential valve stroke switching a design of the valve drive arrangement for switching the primary cams and/or secondary cams can be simplified. In particular the costs of production of the primary cams and/or secondary cams can be reduced, whereby a particularly cost-effective valve drive arrangement can be provided. "Provided" is intended to mean in particular specially equipped and/or designed. A "two stage sequential valve stroke switching" is intended to mean in particular a switching process which causes valve stroke switching one after the other in at least two stages. A "switching process" is to be understood in particular as an axial displacement of at least a part of at least one of the camshaft units. The primary cams and/or secondary cams advantageously comprise at least two different cam curves which can be switched through an axial displacement at least of one of the camshaft units and thus provide for a valve stroke switch-over.

By the multi-part design of the inner shaft a sequential valve stroke switching can be easily realized.

It is advantageous in particular if the shaft elements are provided to form at least part of the inner shaft. A sequential displacement of the inner shaft and thus a sequential valve stroke switching can thereby be realized in a particularly simple manner.

In a further embodiment the at least two shaft elements are connected to each other in a rotationally fixed but axially displaceable way. A separate coupling of the shaft elements to a crankshaft, which is expensive, can thereby be avoided. A sequential displacement of the inner shaft parts which consists of at least two parts is made possible.

It is particularly preferred that at least one of the primary cams and/or at least one of the secondary cams comprises at least two sub-cams which generates different valve strokes. By providing the primary cams and/or the secondary cams as sub-cams the primary cams and/or the secondary cams can be manufactured particularly with different cam curves in a cost-effective manner. In particular a high-expense manufacture of cams with cam curves changing over into each other continuously three dimensionally can be avoided. The sub-cams have different stroke heights, whereby, by a displacement of the primary cams and/or the secondary cams, a particularly advantageous valve stroke switching is made possible.

It is additionally proposed that the adjusting unit comprises at least one shifting gate for axially displacing in at least one operating state at least a part of the primary cams or of the secondary cams. A simple and low-maintenance displacement of the primary cams or the secondary cams can thereby be achieved. A "shifting gate" is to be understood in particular to be an embodiment which converts a rotary movement of the shaft element into an axial force for adjusting the shaft element. The shifting gate preferably comprises at least one slide path, into which an axially fixed switching pin advantageously engages which produces the axial force by means of the shifting gate. In general a displacement of the shaft elements can also take place in another manner known to the person skilled in the art such as for example by means of hydrodynamic, electronic and/or pneumatic actuators. The shifting gate is advantageously provided for sequential displacement of the two shaft elements of the inner shaft.

It is particularly advantageous if the shifting gate couples the at least two shaft elements with each other at least partially in movement terms for sequential displacement. The number of slide guide paths of the shifting gate can thereby be advantageously kept low so that the shifting gate can be constructed in an advantageously compact form. "Coupled with each other partially in movement terms" is thereby to be understood in particular in that the shifting gate is provided to couple, via a switching means engaging in the shifting gate, a displacement of the shaft elements with each other. In particular it is to be understood in that the shifting gate comprises at least one slide path which is provided for sequential displacement of the two shaft elements.

It is also advantageous if the valve drive arrangement comprises a shape locking unit for interconnecting the inner shaft and the outer shaft in an at least partially releasable way to each other at least in one operating state. An operational security can thereby be guaranteed in a simple way.

The at least two camshaft units may also form a combined intake and outlet camshaft. A construction with reduced space and weight requirements can thereby be achieved. A "combined intake and outlet camshaft" is to be understood in particular to be a camshaft in which the primary cams and the secondary cams are formed as coaxially arranged intake and outlet cams. The combined intake and outlet camshaft is provided to activate intake valves and exhaust valves. In order to form a combined intake and outlet camshaft it is particularly advantageous if the camshaft units have different valve activation phases. "Different valve activation phases" are thereby to be understood in particular as an activation of valves which are arranged at a defined angle relative to each other for the creation of different opening times. Two valves of a common cylinder such as for example the intake and exhaust valve of a cylinder are thus never opened simultaneously for example. The activation of the valves thus takes place always at the same rhythm.

It is further advantageous if the valve drive arrangement comprises connecting elements which extend through the outer shaft and establish a fixed connection of the inner shaft with the secondary cams. A displacement of the inner shaft, and thus, of the secondary cams on the outer shaft relative to the primary cams can thus be realized particularly easily.

It is further advantageous if the outer shaft comprises rectangular wall openings assigned to the secondary cams which openings establish at least an axial adjusting path for the valve stroke switching. It is thereby possible in a simple way to facilitate an axial displacement of the inner shaft and thus of the secondary cams. Furthermore a valve stroke switching can thereby be facilitated. The rectangular wall openings also advantageously provide an adjusting path orientated in the peripheral direction for phase adjustment of the cam units relative to each other.

The invention will become more readily apparent from the following description of two embodiments of the invention on the basis of the accompanying drawings.

DESCRIPTION OF PARTICULAR EMBODIMENTS

Figure 1:
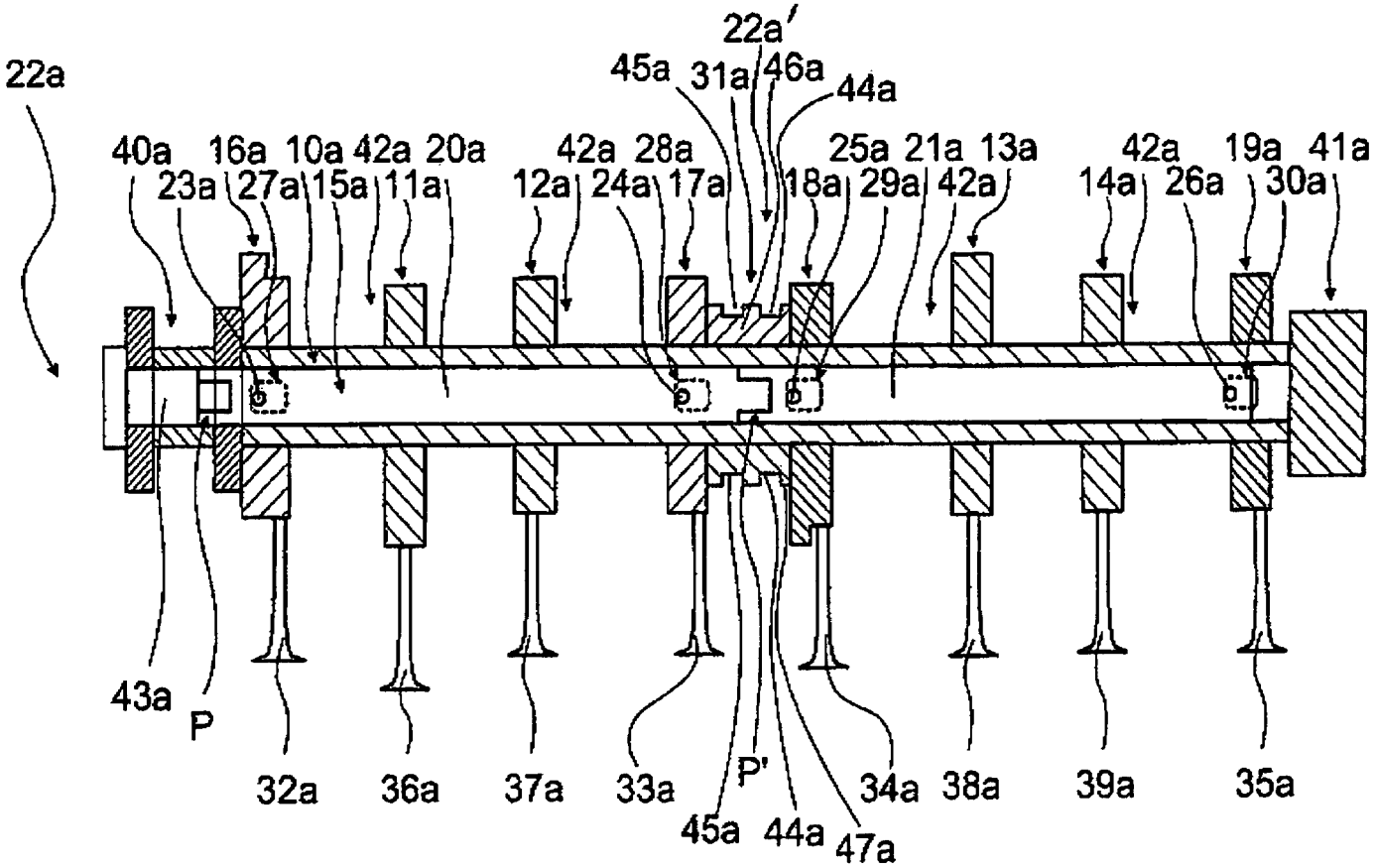
FIG. 1 shows a valve drive arrangement with intake and exhaust valves in a first switching position.

FIG. 1 shows a valve drive arrangement of an internal combustion engine for controlling four cylinders arranged in line. The cylinders respectively comprise at least one intake valve 32*a*, 33*a*, 34*a*, 35*a* and at least one exhaust valve 36*a*, 37*a*, 38*a*, 39*a*. In order to activate the intake valves 32*a*, 33*a*, 34*a*, 35*a* and the exhaust valves 36*a*, 37*a*, 38*a*, 39*a* the valve train device comprises a first camshaft unit and a second camshaft unit which are combined with each other. The first camshaft unit includes an outer shaft 10*a* and primary cams 11*a*, 12*a*, 13*a*, 14*a* connected to the outer shaft 10*a*. The second camshaft unit comprises an inner shaft 15*a* and secondary cams 16*a*, 17*a*, 18*a*, 19*a* connected to the inner shaft 15*a*. The inner shaft 15*a* is axially movably disposed in the outer shaft 10*a*.

The two camshaft units form a combined intake and outlet camshaft which respectively provides for each cylinder a valve activation phase for the intake valves 32*a*, 33*a*, 34*a*, 35*a* and a valve activation phase for the exhaust valves 36*a*, 37*a*, 38*a*, 39*a*. The activation phases of the intake valves 32*a*, 33*a*, 34*a*, 35*a* and the exhaust valves 36*a*, 37*a*, 38*a*, 39*a* differ essentially in that they are displaced relative to each other by approximately 90 degrees. In order to control the cylinders, primary cams 11*a*, 12*a*, 13*a*, 14*a* and secondary cams 16*a*, 17*a*, 18*a*, 19*a* are assigned to the respective cylinder. The exhaust valve 36*a*, 37*a*, 38*a*, 39*a* of a cylinder is activated by a primary cam 11*a*, 12*a*, 13*a*, 14*a* and the intake valve 32*a*, 33*a*, 34*a*, 35*a* by an adjacent secondary cam 16*a*, 17*a*, 18*a*, 19*a*. In order to control the four cylinders the drive arrangement device comprises four primary cams 11*a*, 12*a*, 13*a*, 14*a* and four secondary cams 16*a*, 17*a*, 18*a*, 19*a*.

In order to adjust the camshaft units relative to each other the valve drive arrangement comprises an adjusting unit 22*a*, 22*a*' which has two functions. A first function, that is the function of the adjusting unit 22*a*, resides in a phase adjustment of the two camshaft units. The adjusting unit 22*a* is provided in particular to adjust a relative phase of the two cam units relative to each other. In order to adjust the phase the adjusting unit 22*a* can comprise for example at least one adjusting element which is effectively arranged between the two camshaft units. In principle a design with two adjusting elements which can be adjusted independently of each other and of which one is effectively arranged between a crankshaft and one of the cam units is also conceivable. Vane adjusters can thereby be used as adjusting elements.

A second function that is, the function of the adjusting unit 22*a*' is to provide for an axial displacement of the first camshaft unit relative to the second camshaft unit, wherefor a two stage sequential valve stroke switching is provided. By means of the adjusting unit 22*a*' a valve stroke can be switched for the intake valves 32*a*, 33*a*, 34*a*, 35*a*.

Figure 2:
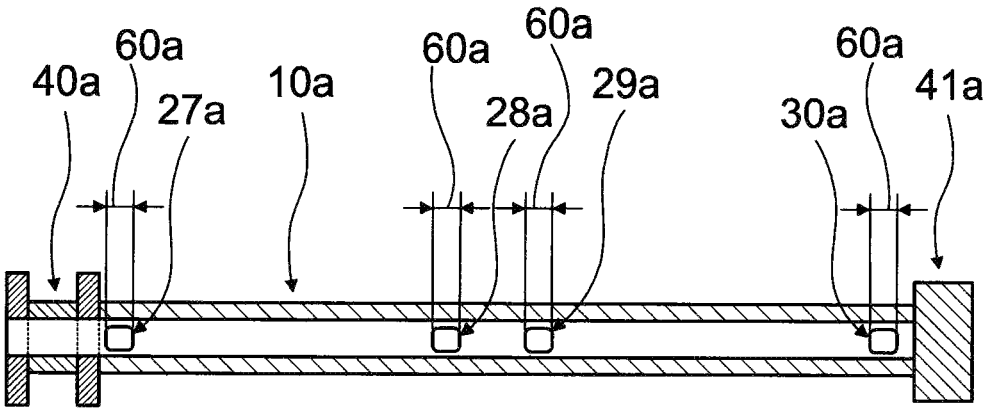
FIG. 2 shows an outer shaft of the valve drive arrangement.

The outer shaft 10*a* is formed as a hollow shaft (see FIG. 2), which is rotationally securely and axially securely connected to the primary cams 11*a*, 12*a*, 13*a*, 14*a*. The primary cams 11*a*, 12*a*, 13*a*, 14*a* have a cam curve which is provided for the activation of the exhaust valves 36*a*, 37*a*, 38*a*, 39*a*. For supporting the outer shaft 10*a* at least one drive-side first bearing location 40*a* and a second bearing location 41*a* arranged at the opposite shaft end are provided. The first bearing location 40*a* is provided with a fixed bearing. The second bearing location 41*a* is provided for an axially movable support. Further bearing points 42*a* are provided between the two bearing locations 40*a*, 41*a*.

Figure 3:
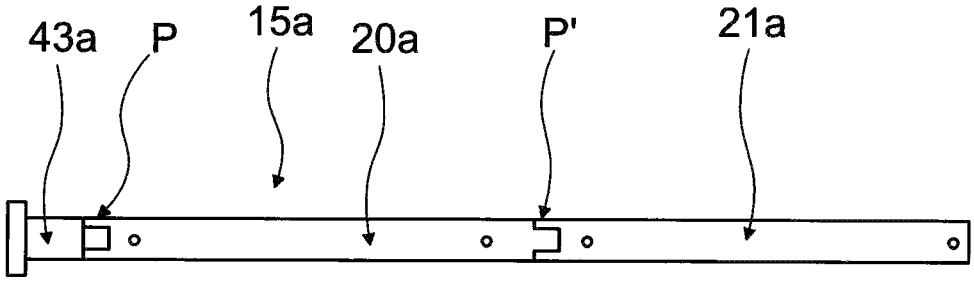
FIG. 3 shows an inner shaft of the valve drive arrangement.

The secondary cams 16*a*, 17*a*, 18*a*, 19*a* are mounted in a rotationally and axially displaceable manner on the outer shaft 10*a*. The inner shaft 15*a* guided in the outer shaft 10*a* is in the form of a multiple part shaft (cf FIG. 3). It comprises a drive flange 43*a* which is effectively coupled with a crankshaft (not shown) and two shaft elements 20*a*, 21*a* which are respectively coupled with the secondary cams 16*a*, 17*a*, 18*a*, 19*a*. The secondary cams 16*a*, 17*a*, 18*a*, 19*a* respectively comprise two sub-cams which have different cam curves. Through the axial displacement of the inner shaft 15*a* and thus also of the secondary cams 16*a*, 17*a*, 18*a*, 19*a* a valve stroke switching is carried out. By the use of the secondary cams 16*a*, 17*a*, 18*a*, 19*a* as intake cams, in case of valve stroke switching in particular the valve stroke of the intake valves 32*a*, 33*a*, 34*a*, 35*a* of the various cylinders are switched.

The two shaft elements 20*a*, 21*a*, of the inner shaft 15*a* are connected to each other in an axially displaceable and rotationally fixed manner. The secondary cams 16*a*, 17*a*, 18*a*, 19*a* are respectively coupled in pairs with one of the shaft elements 20*a*, 21*a*. For the fixed connection of the inner shaft 15*a* with the secondary cams 16*a*, 17*a*, 18*a*, 19*a* the second camshaft unit comprises connecting elements 23*a*, 24*a*, 25*a*, 26*a* which extend through the outer shaft 10*a* connect the shaft elements 20*a*, 21*a* respectively in a rotationally fixed and axially fixed manner to the associated secondary cams

16*a*, 17*a*, 18*a*, 19*a*. The connecting elements 23*a*, 24*a*, 25*a*, 26*a* are in this embodiment in the form of bolts.

The outer shaft 10*a* comprises wall openings 27*a*, 28*a*, 29*a*, 30*a*, by which one of the connecting elements 23*a*, 24*a*, 25*a*, 26*a* is respectively accommodated. The four wall openings 27*a*, 28*a*, 29*a*, 30*a* are of rectangular shape. The connecting elements 23*a*, 24*a*, 25*a*, 26*a* extend through the wall openings 27*a*, 28*a*, 29*a*, 30*a* in the outer shaft 10*a*. the size of the wall opening 27*a*, 28*a*, 29*a*, 30*a* corresponds in the peripheral direction to the phase angle which can be adjusted between the camshaft units. The axial length of the wall opening 27*a*, 28*a*, 29*a*, 30*a* corresponds to an axial adjusting path 60*a* for valve stroke switching.

The shaft elements 20*a*, 21*a* of the inner shaft 15*a* are displaced sequentially one after the other by means of the adjusting unit 22*a* in a switching process. In order to move the shaft elements 20*a*, 21*a* and thus also the secondary cams 16*a*, 17*a*, 18*a*, 19*a* the adjusting unit 22*a* comprises a first and a second switching means which can displace the shaft elements 20*a*, 21*a* by means of a shifting gate 31*a*.

The first switching means comprises a first actuator and a first switching element. The switching element is partially formed as a switching pin which is moved in a switching position out of the first switching element. In the switching position the switching pin engages in a first slide path 44*a* of the shifting gate 31*a* (cf FIG. 4). By means of the first switching means and the first slide path 44*a* the shaft elements 20*a*, 21*a* can be displaced in a first switching direction.

The second switching means is similarly designed. It comprises a second actuator and a second switching element which is also formed in part as a switching pin. The switching pin engages in the switching position in a second slide path 45*a* of the shifting gate 31*a*. By means of the second switching means and the second slide path 45*a* the shaft elements 20*a*, 21*a* can be displaced in a second switching direction opposite the first switching direction.

The slide paths 44*a*, 45*a*, by means of which the shaft elements 20*a*, 21*a* are displaced, are designed as groove-like depressions. In order to form the slide paths 44*a*, 45*a* the shifting gate 31*a* comprises two slide path elements 46*a*, 47*a* which are respectively connected to one of the shaft elements 20*a*, 21*a*. The slide paths 44*a*, 45*a* are directly incorporated into the slide path elements 46*a*, 47*a*. In order to displace the shaft elements 20*a*, 21*a* sequentially the slide path elements 46*a*, 47*a* are designed in a region in which they abut each other in an L shape and overlap each other axially. In the peripheral direction each slide path element 46*a*, 47*a* assumes in the region of the slide paths 44*a*, 45*a* a rotation angle of 180°. The slide paths 44*a*, 45*a* which extend tend over a rotation angle greater than 360° are respectively arranged in part on the shaft element 20*a* and in part on the shaft element 21*a*.

Figure 4:
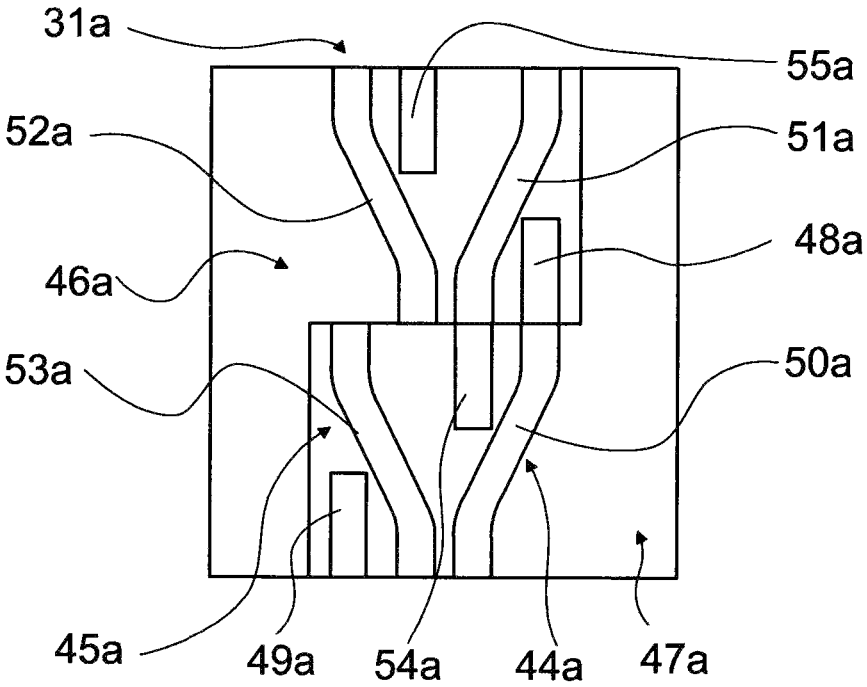
FIG. 4 shows slide paths of a shifting gate.

Both slide paths 44*a*, 45*a* comprise a basic form with a double S-shaped structure (cf FIG. 4). The slide paths 44*a*, 45*a* respectively comprise an engaging segment 48*a*, 49*a* for engagement of the switching pin, respectively two switching segments 50*a*, 51*a*, 52*a*, 53*a* for sequential displacement of the slide path elements 46*a*, 47*a* and respectively a disengaging segment 54*a*, 55*a*, by means of which the switching elements are moved in again. The switching segments 50*a*, 51*a*, 52*a*, 53*a* are respectively completely arranged on one of the slide path elements 46*a*, 47*a* whereby switching segments 50*a*, 51*a*, 52*a*, 53*a* following each other are alternately arranged on the slide path elements 46*a*, 47*a*. By means of the switching segments 50*a*, 51*a*, 52*a*, 53*a* and a rotation movement of the slide path elements 46*a*, 47*a* the axial force is provided for switching the shaft elements 20*a*, 21*a*. The switching segments 50*a*, 51*a*, 52*a*, 53*a* of the two slide paths 44*a*, 45*a* are thereby provided for different switching directions. The slide path elements 46*a*, 47*a*, are respectively fixedly connected to the adjacently arranged secondary cams 17*a*, 18*a*. Through the fixed connection of the secondary cams 17*a*, 18*a* to the associated shaft element 20*a*, 21*a* an axial displacement of the slide path elements 46*a*, 47*a* leads to an axial displacement of the associated shaft element 20*a*, 21*a* and thus to an axial displacement of the secondary cams 16*a*, 17*a*, 18*a*, 19*a*.

The shaft elements 20*a*, 21*a* are partially coupled in movement terms with each other via the shifting gate 31*a*. By means of the adjusting unit 22*a*' the shaft elements 20*a*, 21*a* can be sequentially displaced. The shaft elements 20*a*, 21*a* are thereby displaced in dependence upon a rotation angle of the valve drive arrangement. In the first switching direction initially the shaft element 21*a* is displaced and subsequently when the shaft element 21*a* has been completely displaced the shaft element 20*a* is displaced. In the second switching direction initially the shaft element 20*a* and subsequently the shaft element 21*a* are displaced. Through the movement-based coupling a displacement of a shaft element 20*a*, 21*a* leads, in dependence upon a speed of the inner shaft 15*a*, to the temporally offset displacement of the other shaft element 20*a*, 21*a*. A displacement of only one shaft element 20*a*, 21*a* without a subsequent displacement of the other shaft element 20*a*, 21*a* is not possible.

The shaft element 21*a* and the shaft element 20*a* are connected to each other at a coupling point P' in a rotationally fixed and axially displaceable manner, for example by means of toothing. Furthermore the drive flange 43*a* is also connected at a coupling point P in a rotationally fixed and axially displaceable manner, for example by means of toothing, to the shaft element 20*a*. A torque is introduced via the drive flange 43*a*, transferred via the coupling point P to the shaft element 20*a* and forwarded via the coupling point P' to the shaft element 21*a*.

The two actuators which move the switching elements respectively comprise an electromagnetic unit for moving out the switching elements. The actuators are designed as bistable systems, wherein the switching element remains in its position in case of a de-energized electromagnetic unit both in the moved-in state and in the moved-out state. In order to move out the switching elements the corresponding electromagnetic unit is de-energized. Moving in of the switching elements is realized by means of the slide paths 44*a*, 45*a*.

By means of the switching segments 50*a*, 51*a*, 52*a*, 53*a* two different switching positions of the shaft elements 20*a*, 21*a* can be switched. The secondary cams 16*a*, 17*a*, 18*a*, 19*a* respectively comprise two sub-cams, by means of which the different cam curves of the secondary cams 16*a*, 17*a*, 18*a*, 19*a* are provided. The sub-cams are assigned to the switching positions of the shaft elements 20*a*, 21*a*. The sub-cams of a secondary cam 16*a*, 17*a*, 18*a*, 19*a* which are provided for the optional activation of precisely one intake valve 32*a*, 33*a*, 34*a*, 35*a* are respectively arranged directly adjacent to each other. A base circle phase of the sub-cams of a secondary cam 16*a*, 17*a*, 18*a*, 19*a* is respectively equal. The switching segments 50*a*, 51*a*, 52*a*, 53*a* displace the shaft elements 20*a*, 21*a* respectively in the base circle phase of the secondary cams 16*a*, 17*a*, 18*a*, 19*a* assigned to the corresponding shaft element 20*a*, 21*a*.

The cam curves of a secondary cam 16*a*, 17*a*, 18*a*, 19*a* differ essentially in a stroke height. The small cam curves are assigned to the first switching position and have a small stroke height. The large cam curves are assigned to the second switching position and have a large stroke height. The first sub-cams have a small cam curve and the second sub-cams a large cam curve. The intake valves 32*a*, 33*a*, 34*a*, 35*a* which are activated with a secondary cam 16*a*, 17*a*, 18*a*, 19*a* with two sub-cams with differing cam curves are activated in a first switching position of the shaft elements 20*a*, 21*a* with the sub-cam of the secondary cam 16*a*, 17*a*, 18*a*, 19*a* which has a smaller stroke height in relation to the adjacent sub-cam. In a second switching position of the shaft elements 20*a*, 21*a* the associated intake valves 32*a*, 33*a*, 34*a*, 35*a* which are activated with a secondary cam 16*a*, 17*a*, 18*a*, 19*a* with two sub-cams with different cam curves are activated with the sub-cam of the secondary cam 16*a*, 17*a*, 18*a*, 19*a* which has a greater stroke height in relation to the adjacent sub-cam.

Figure 6:
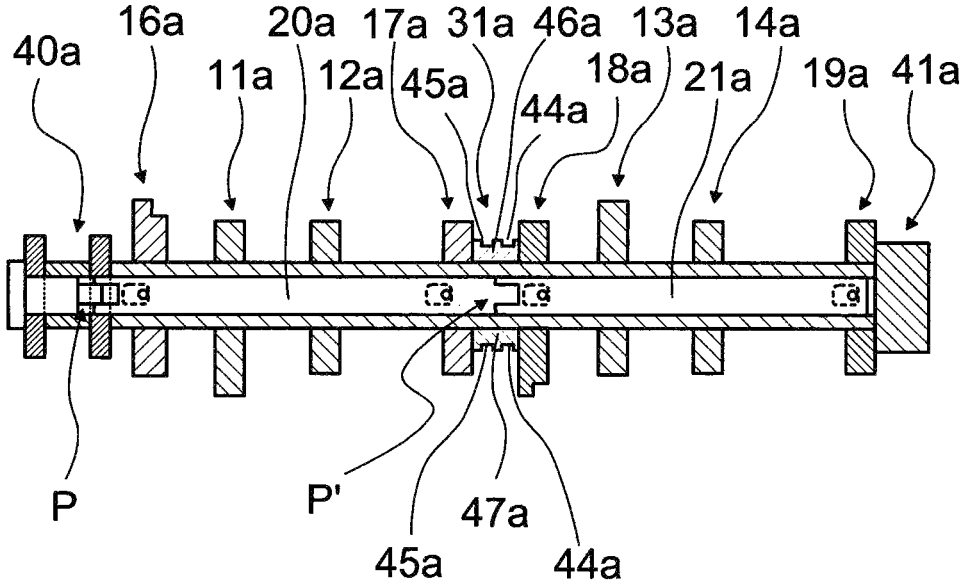
FIG. 6 shows the valve drive arrangement in the second switching position.

In the first switching position the shaft element 20*a* is displaced axially as far as the stop on the drive flange 43*a*. The shaft element 21*a* is axially displaced in the first switching position as far as the stop on the shaft element 20*a* (cf FIG. 1). In the second switching position the shaft element 21*a* is displaced axially as far as a stop of the outer shaft 10*a*. The shaft element 20*a* is axially displaced in the second switching position as far as the stop on the shaft element 21*a* (cf FIG. 6). In the first switching position the sub-cams with the small stroke are assigned to the intake valves 32*a*, 33*a*, 34*a* 35*a* and in the second switching position the sub-cams with the large stroke are assigned thereto.

In order to fix the shaft elements 20*a*, 21*a* in their switching positions the valve train device comprises a shape locking unit which respectively comprises two pressure elements assigned respectively to one of the shaft elements 20*a*, 21*a*. In the switching positions the pressure elements of the shape locking unit connect the shaft elements 20*a*, 21*a* of the inner shaft 15*a* releasably with the outer shaft 10*a*. The outer shaft 10*a* comprises on its inner side recesses which are assigned to the switching positions and into which the pressure elements fixedly connected to the inner shaft 15*a* engage in the switching positions. The shape locking unit is formed by means of the pressure elements as a ball latching element.

Figure 5:
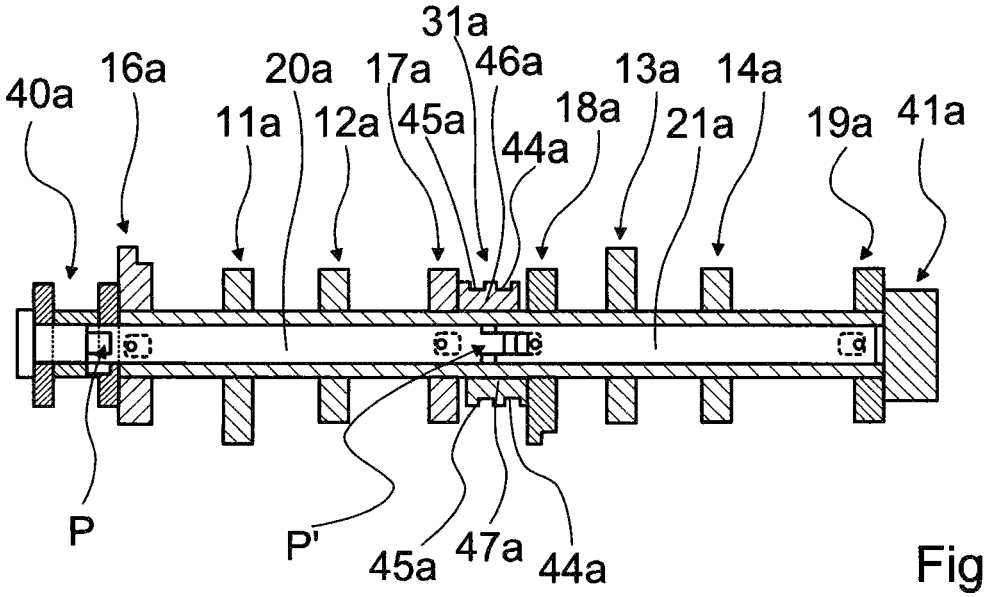
FIG. 5 shows the valve drive arrangement during a switching process from a first switching position into a second switching position.

In an operating state in which the shaft elements 20*a*, 21*a* are switched in the first switching position the intake valves 32*a*, 33*a*, 34*a*, 35*a* are activated by means of the first sub-cams. In order to switch the shaft elements 20*a*, 21*a* into the second switching position, in which the intake valves 32*a*, 33*a*, 34*a*, 35*a*, are activated by means of the second sub-cams, the first switching means is switched into its switching position, whereby the first switching pin engages in the engaging segment 48*a*. The form of the switching segment 50*a* provides, by means of the rotation movement of the inner shaft 15*a*, an axial force which displaces the shaft element 21*a* and the secondary cams 18*a*, 19*a* connected to the shaft element 21*a* in the direction of the second bearing point 41*a*. The shaft element 21 is thus switched into the second switching position while the activation of the intake valves 32*a*, 33*a* which are activated by the remaining secondary cams 16*a*, 17*a* coupled with the shaft element 20*a* remains unchanged (cf FIG. 5). In this operating state the switching process of the shaft elements 20*a*, 21*a* is half completed. Through a further rotation movement of the inner shaft 15*a* the shaft element 20*a* is then switched by means of the first switching pin and the switching segment 51*a* into its second switching position, whereby the second sub-cams are also switched (FIG. 6) for the secondary cams 16*a*, 17*a* coupled with the shaft element 20*a*. The switching process is concluded by reaching the disengaging segment 54*a* and the moving in of the first connecting pin. The valve stroke switching thus takes place as a two-stage sequential valve stroke switching.

A switching process from the second switching position back into the first switching position takes place similarly, whereby the second switching pin engages in the second slide path 45*a* and the shaft elements 20*a*, 21*a*, starting with the shaft element 20*a*, are displaced one after the other into the first switching position. In case of the switching process into the first switching position a two stage sequential valve stroke switching also takes place.

Figure 7:
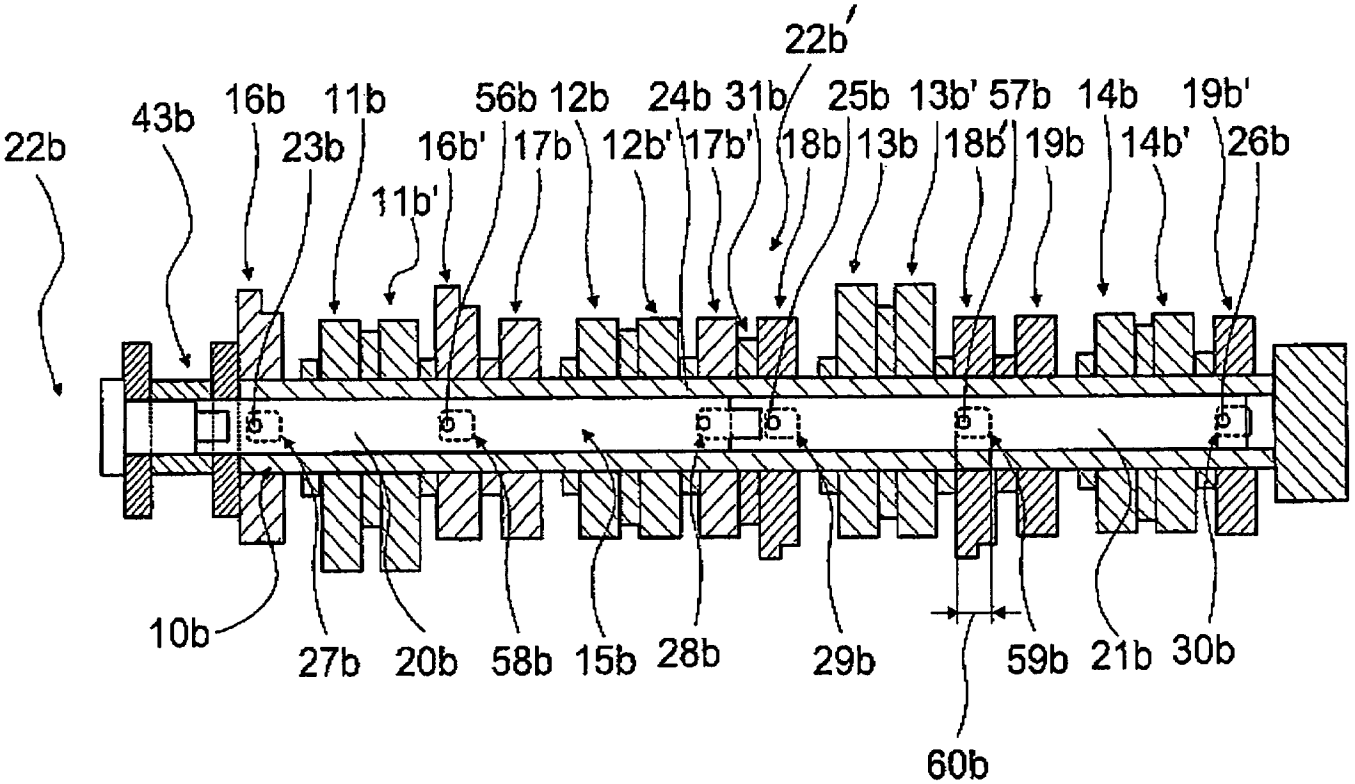
FIG. 7 shows an alternatively designed valve drive arrangement for a multi-valve technology.

FIG. 7 shows a further embodiment of the invention. In order to differentiate the embodiments the letter "a" is replaced in the reference numerals of the embodiment in FIGS. 1 to 6 by the letter "b" in the reference numerals of the embodiment in FIG. 7. The subsequent description is limited essentially to differences between the embodiments. Having regard to components, functions and features which remain the same reference can be made to the description and/or the drawings of the embodiments in FIGS. 1 to 6.

FIG. 7 shows a a valve drive arrangement for an internal combustion engine having four cylinders arranged in line. Unlike the previous embodiment, two intake valves and two exhaust valves are assigned to each cylinder. In order to activate the intake valves and the exhaust valves the valve train device comprises a first camshaft unit and a second camshaft unit which are combined with each other. The first camshaft unit comprises an outer shaft 10*b* and primary cams 11*b*, 11*b*', 12*b*, 12*b*', 13*b*, 13*b*', 14*b*, 14*b*' connected to this outer shaft 10*b*. The second camshaft unit comprises an inner shaft 15*b* and secondary cams 16*b*, 16*b*', 17*b*, 17*b*', 18*b*, 18*b*', 19*b*, 19*b*' connected to this inner shaft 15*b*. The primary cams 11*b*, 11*b*', 12*b*, 12*b*', 13*b*, 13*b*', 14*b*, 14*b*' are formed by means of two sub-cams with the same cam curves and the secondary cams 16*b*, 16*b*', 17*b*, 17*b*', 18*b*, 18*b*', 19*b*, 19*b*' by means of two sub-cams with different cam curves.

The two camshaft units form a combined intake and outlet camshaft which respectively comprise for each cylinder a valve activation phase for the intake valves and a valve activation phase for the exhaust valves. The outer shaft 15*b* is a hollow shaft, in which an inner shaft 15*b* comprising multiple components is disposed. The inner shaft 15*b* includes a drive flange 43*b* and two shaft elements 20*b*, 21*b*. The drive flange 43*b* and the two shaft elements 20*b*, 21*b* are connected, to each other in a rotationally fixed and axially displaceable manner.

In order to turn and displace the camshaft units relative to each other the valve train device comprises an adjusting unit 22*b*. For axial displacement of the shaft elements 20*b*, 21*b* the adjusting unit 22*b* comprises a shifting gate 31*b* which displaces the two shaft elements 20*b*, 21*b* sequentially in two stages.

The primary cams 11*b*, 11*b*', 12*b*, 12*b*', 13*b*, 13*b*', 14*b*, 14*b*' for activating the exhaust valves of the same cylinders are respectively arranged directly adjacent and thus separate the associated secondary cams 16*b*, 16*b*', 17*b*, 17*b*', 18*b*, 18*b*', 19*b*, 19*b*'. The secondary cams 16*b*', 17*b*, the secondary cams 17*b*', 18*b* and the secondary cams 18*b*', 19*b* are also arranged directly adjacent whereby the secondary cams 16*b*', 17*b*, 17*b*', 18*b*, 18*b*', 19*b* are responsible for activating intake valves of different cylinders. The directly adjacent secondary cams 16*b*', 17*b* and the secondary cams 18*b*', 19*b* are firmly connected to each other. And the directly adjacent secondary cams 17*b*', 18*b* are connected by means of the shifting gate 31*b*. For fixed connection of the inner shaft 15*b* to the secondary cams 16*b*, 16*b*', 17*b*, 17*b*', 18*b*, 18*b*', 19*b*, 19*b*' the second camshaft unit comprises connecting elements 23*b*, 24*b*, 25*b*, 26*b*, 56*b*, 57*b* which, respectively, connect in a rotationally fixed and axially fixed manner the shaft elements 20*b*, 21*b* to the associated secondary cams 16*b*, 16*b*', 17*b*, 17*b*', 18*b*, 18*b*', 19*b*, 19*b*' by bolts extending through openings on the outer shaft 10. The connecting element 56*b* is provided for the fixed connection of the directly adjacent secondary cams 16*b*', 17*b* and the connecting element 57*b* is provided for the fixed connection of the directly adjacent secondary cams 18*b*', 19*b* to the shaft element 20*b*, 21*b*. With such an arrangement of the primary cams 11*b*, 11*b*', 12*b*, 12*b*', 13*b*, 13*b*', 14*b*, 14*b*' and secondary cams 16*b*, 16*b*', 17*b*, 17*b*', 18*b*, 18*b*', 19*b*, 19*b*' the outer shaft 10*b* comprises, in contrast to the previous embodiment, respectively three wall openings 27*b*, 28*b*, 29*b*, 30*b*, 58*b*, 59*b*. Through the wall openings 27*b*, 28*b*, 29*b*, 30*b*, 58*b*, 59*b* the secondary cams 16*b*, 16*b*', 17*b*, 17*b*', 18*b*, 18*b*', 19*b*, 19*b*' which are disposed on the outer shaft 10*b*, in such a way that they can rotate and be displaced axially, are connected by means of the connecting elements (23*b*, 36*b*) fixedly to the inner shaft 15*b*, whereby the secondary cams 16*b*', 17*b* and the secondary cams 18*b*', 19*b* are coupled with each other.

What is claimed is:

1. A valve drive arrangement for an internal combustion engine including a first camshaft unit which comprises an outer shaft with primary cams connected to the outer shaft, a second camshaft unit which comprises an inner shaft disposed in the outer shaft and having secondary cams movably disposed on the outer shaft but connected to the inner shaft for movement with the inner shaft relative to the outer shaft and an adjusting unit disposed on the outer shaft and also connected to the inner shaft for adjusting the axial position of the two camshaft units relative to each other, the inner shaft comprising at least two shaft elements which are arranged axially adjacent one another and interconnected by an axial slide coupling (P') for common rotation but axial displacement in sequence, one after the other, during a switching process, and the inner shaft being furthermore rotatable relative to the outer shaft together with the secondary cams supported on the outer shaft for an adjustment of the phase angle between the primary cams mounted on the outer shaft and the secondary cams rotatably supported on the outer shaft but connected, by connecting elements, to the inner shaft elements for rotation and axial movement therewith.

2. The valve drive arrangement according to claim 1, wherein the inner shaft formed by the shaft elements is rotatably and axially movably supported in the outer shaft.

3. The valve drive arrangement according to claim 1, wherein the two inner shaft elements are connected to each other in a rotationally fixed but axially displaceable manner.

4. The valve drive arrangement according to claim 1, wherein at least one of the secondary cams comprises at least two sub-cams having shapes providing for different valve strokes.

5. The valve drive arrangement according to claim 1, wherein the adjusting unit comprises at least one shifting gate for axially displacing at least a part of the primary secondary cams and at least one additional shifting gate for axially displacing at least a another part of the secondary cams.

6. The valve drive arrangement according to claim 1, wherein the shifting gates are provided for axially moving the two shaft elements relative to each other for sequential axial displacement thereof together with the respective secondary cams.

7. The valve drive arrangement according to claim 1, wherein the first and second camshaft units form together a combined intake and outlet camshaft.

8. The valve drive arrangement according to claim 1, wherein the camshaft units have different valve activation phases.

9. The valve drive arrangement according to claim 1, wherein the connecting elements extend through openings in the outer shaft to fixedly interconnect the inner shaft and the secondary cams disposed on the outer shaft.

10. The valve drive arrangement according to claim 1, wherein the outer shaft comprises rectangular wall openings assigned to the secondary cams which wall openings are sized to form an axial adjustment path for valve stroke switching and also a circumferential adjustment path permitting a phase adjustment between the outer and the inner shafts.

11. The valve drive arrangement according to claim 10, wherein the rectangular wall openings have an axial length as required for the axial movement of the cam elements for valve lift adjustment and a width in a direction exceeding the width of the connecting elements so as to permit phase adjustment of the inner shaft and the secondary cams relative to the outer shaft.

* * * * *